United States Patent [19]

Oomura et al.

[11] Patent Number: 4,798,177

[45] Date of Patent: Jan. 17, 1989

[54] SYSTEM FOR CONTROLLING ROTATIONAL SPEED OF HYDRAULICALLY DRIVEN COOLING FAN OF INTERNAL COMBUSTION ENGINE, RESPONSIVE TO ENGINE COOLANT AND ALSO FAN PROPELLANT TEMPERATURE

[75] Inventors: Seiji Oomura; Kashirou Fukami, both of Toyota; Masao Inagaki; Tooru Hamamoto, both of Okazaki, all of Japan

[73] Assignee: Toyota Jidosha Kabushiki Kaisha, Aichi, Japan

[21] Appl. No.: 116,340

[22] Filed: Nov. 4, 1987

[30] Foreign Application Priority Data

Nov. 12, 1986 [JP] Japan ..... 61-268938

[51] Int. Cl.[4] ..... F01P 7/02

[52] U.S. Cl. ..... 12.3/41.12; 123/41.02

[58] Field of Search ..... 123/41.12, 41.49, 41.08, 123/41.11, 41.44, 41.62, 41.63, 41.65; 165/39; 236/6, 35; 417/212, 214, 307

[56] References Cited

U.S. PATENT DOCUMENTS

| | | | |
|---|---|---|---|
| 3,664,129 | 5/1972 | Schwab | 60/53 R |
| 4,062,329 | 12/1977 | Rio | 123/41.12 |
| 4,179,888 | 11/1979 | Goscenski, Jr. | 60/420 |
| 4,223,646 | 9/1980 | Kinder | 123/41.11 |
| 4,348,990 | 9/1982 | Nolte | 123/41.12 |
| 4,414,809 | 11/1983 | Burris | 60/424 |
| 4,433,648 | 2/1984 | LeBlanc | 123/41.12 |
| 4,479,532 | 10/1984 | Watanabe | 123/41.12 |
| 4,539,943 | 9/1985 | Tsuchikawa | 123/41.12 |
| 4,570,849 | 2/1986 | Klaucke et al. | 236/35 |
| 4,709,666 | 12/1987 | Merz | 123/41.12 |

FOREIGN PATENT DOCUMENTS

| | | |
|---|---|---|
| 49-40135 | 4/1974 | Japan . |
| 56-83630 | 7/1981 | Japan . |
| 58-13119 | 1/1983 | Japan . |

*Primary Examiner*—Rayond A. Nelli

*Attorney, Agent, or Firm*—Kenyon & Kenyon

[57] ABSTRACT

A cooling fan for an internal combustion engine hydraulically driven by a flow of propellant hydraulic fluid is controlled of its rotational speed by a system which includes a device for sensing a value representing the operating temperature of the engine, a device for sensing the operating temperature of the propellant hydraulic fluid, and a device for controlling the flow of the propellant hydraulic fluid, so as to increase the flow rate of the propellant hydraulic fluid when the operating temperature of the engine increases and also when the operating temperature of the propellant hydraulic fluid increases.

1 Claim, 1 Drawing Sheet

SYSTEM FOR CONTROLLING ROTATIONAL SPEED OF HYDRAULICALLY DRIVEN COOLING FAN OF INTERNAL COMBUSTION ENGINE, RESPONSIVE TO ENGINE COOLANT AND ALSO FAN PROPELLANT TEMPERATURE

BACKGROUND OF THE INVENTION

The present invention relates to a system for controlling the rotational speed of a hydraulically driven cooling fan for an internal combustion engine, and more particularly relates to such a system for controlling the rotational speed of a hydraulically driven cooling fan for an internal combustion engine according to the temperature of the propelling hydraulic fluid that is being used for hydraulically driving said cooling fan as well as according to the temperature of the coolant of said internal combustion engine.

It is known from, for example, Japanese Utility Model Publication No. 49-40183 (1974) and Japanese Patent Laying Open Publication No. 58-13119 (1983) to propel a cooling fan for an internal combustion engine of an automotive vehicle by hydraulic fluid under control of the rotational speed thereof by varying the rate of flow of such propellant hydraulic fluid to a hydraulic motor which drives said cooling fan, in such a way as to increase said rotational speed along with increase of the temperature of the coolant fluid for the internal combustion engine.

However, when the temperature of the propellant hydraulic fluid for the hydraulic motor varies as is inevitable, the efficiency of the hydraulic motor varies, and as a result the rotational speed of said cooling fan is varied. Thus, even if the flow rate of said propellant hydraulic fluid is controlled depending upon the temperature of the coolant of the internal combustion engine, when the propellant hydraulic fluid is at a relatively high operating temperature the rotational speed of the cooling fan may fall short of its target rotational speed, thereby engendering a risk of poor cooling of the internal combustion engine. In the contrary case, when the propellant hydraulic fluid is at a relatively low operating temperature, the rotational speed of the cooling fan may exceed its target rotational speed, thereby engendering a risk of over cooling of the internal combustion engine and causing an annoying fan noise, as well as reducing overall engine efficiency.

SUMMARY OF THE INVENTION

Accordingly, it is the primary object of the present invention to provide an improved system for controlling the rotational speed of a hydraulically driven cooling fan for an internal combustion engine, which avoids the problems described above.

It is a further object of the present invention to provide such a system for controlling the rotational speed of such a hydraulically driven engine cooling fan, which effectively compensates for changes of the temperature of the propellant hydraulic fluid for the cooling fan.

It is a further object of the present invention to provide such a system for controlling the rotational speed of such a hydraulically driven engine cooling fan, which ensures that the rotational speed of said fan is always properly and stably set to the target rotational speed therefor.

It is a further object of the present invention to provide such a system for controlling the rotational speed of such a hydraulically driven engine cooling fan, which does not run any risk that said rotational speed of said fan should be too low or too high for the currently prevailing operational circumstances.

It is a further object of the present invention to provide such a system for controlling the rotational speed of such a hydraulically driven engine cooling fan, which does not run any risk of causing unpleasant fan noise.

According to the most general aspect of the present invention, these and other objects are attained by, for a cooling fan for an internal combustion engine, said cooling fan being driven hydraulically by a flow of propellant hydraulic fluid: a system for controlling its rotational speed, comprising: (a) a means for sensing a value representing the operating temperature of said engine; (b) a means for sensing the operating temperature of said propellant hydraulic fluid; and: (c) a means for controlling said flow of propellant hydraulic fluid, for increasing the flow rate of said flow of propellant hydraulic fluid when said means for sensing said value representing the operating temperature of said engine indicates increased operating temperature of said engine, and also for increasing the flow rate of said flow of propellant hydraulic fluid when said means for sensing the operating temperature of said propellant hydraulic fluid indicates increased operating temperature of said propellant hydraulic fluid.

Such a system for controlling the rotational speed of a hydraulically driven cooling fan for an internal combustion engine appropriately and effectively compensates for changes of the temperature of the propellant hydraulic fluid for the cooling fan, thereby ensuring that the rotational speed of said fan is always properly and stably set to the target rotational speed therefor, and preventing any risk that said rotational speed of said fan should be too low or too high for the currently prevailing operational circumstances. Accordingly, any risk of not providing sufficient cooling effect for said engine, or alternatively of providing too much cooling effect for said engine or of causing unpleasant fan noise or lowering engine operational efficiency, is prevented.

And, according to a particular specialization of the present invention, the above and other objects may more particularly be accomplished by such a system for controlling the rotational speed of a hydraulically driven cooling fan for an internal combustion engine as specified above, wherein said means for controlling said flow of propellant hydraulic fluid comprises a controller and a flow rate control valve. In this case, said controller may control said flow rate control valve by duty factor control; and said flow rate control valve may be provided in a conduit which bypasses a portion of said flow of propellant hydraulic fluid for hydraulically driving said cooling fan, from driving said cooling fan.

BRIEF DESCRIPTION OF THE DRAWINGS

The present invention will now be described with respect to the preferred embodiment thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified, and:

DESCRIPTION OF THE PREFERRED EMBODIMENT

Overall Structure

Figure 1:
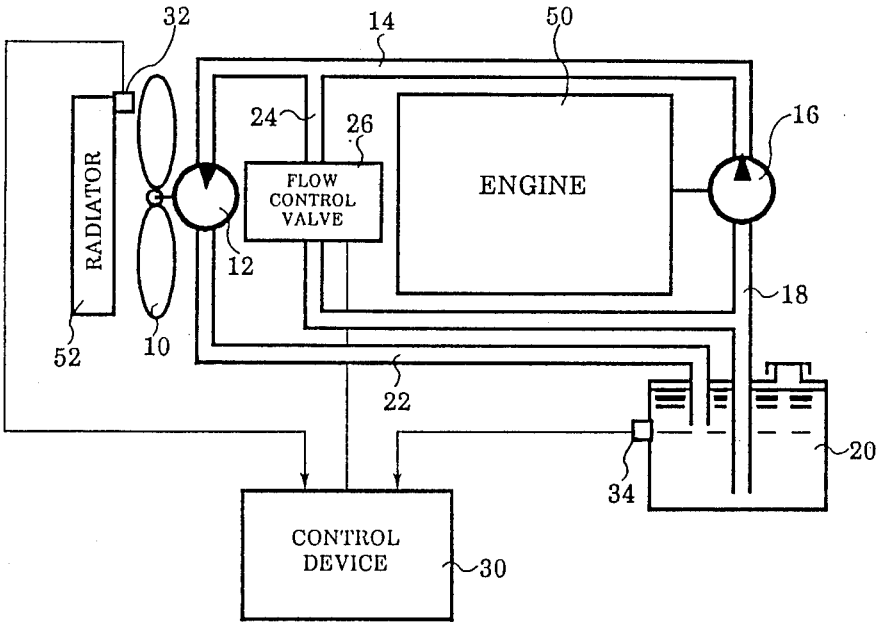
FIG. 1 is a schematic view of a preferred embodiment of the system for controlling the rotational speed of a hydraulically driven engine cooling fan of the present invention.

Referring to FIG. 1 the reference numeral 50 denotes an internal combustion engine, typically fitted to an automotive vehicle which is equipped with a radiator 52. A cooling fan 10 is provided for blowing a stream of air at this radiator 52, and this cooling fan 10 is rotationally driven by a hydraulic motor 12 which is of a per se conventional type, and, as is typical, provides the less torque to its rotational power output member connected to the cooling fan 10 and rotates said cooling fan 10 the slower, the higher is the temperature of the propellant hydraulic fluid supplied to said hydraulic motor 12.

The intake port of this hydraulic motor 12 is connected by a hydraulic conduit 14 to the output port of a hydraulic fluid pump 16 which is rotationally driven by the engine 1. This hydraulic fluid pump 16 is provided with a built in relief valve (not shown in the drawings) so as to restrict its output pressure not to exceed a determinate value. And the intake port of this hydraulic fluid pump 16 is connected by a hydraulic conduit 18 to a reservoir tank 20 and sucks up and receives a supply of hydraulic fluid therefrom. Further, the outlet port of the hydraulic motor 12 is connected by another hydraulic conduit 22 to this reservoir tank 20, so as to return spent hydraulic fluid to said reservoir tank 20.

An intermediate point along the hydraulic conduit 14 is connected to an intermediate point along the hydraulic conduit 18 via a bypass conduit 24 which incorporates a flow control valve 26 therein. The flow control valve 26 operates according to an electrical control signal from a control device 30, so as to allow more or less flow of hydraulic fluid through the bypass conduit 24, or more exactly so as to vary the flow resistance to hydraulic fluid of said bypass conduit 24; in this preferred embodiment of the present invention, this flow control valve 26 is an ON/OFF type of flow control valve and is electrically driven, incorporating a solenoid or the like device.

In this preferred embodiment, the flow control valve 26 is controlled by a pulse electrical signal outputted by the control device 30, and the frequency of this pulse electrical signal is kept substantially constant by the control device 30, while its duty ratio is varied, so as to control the overall flow resistance to hydraulic fluid of said bypass conduit 24 by opening and closing the flow control valve 26 with a corresponding duty ratio. In this preferred embodiment, when said pulse electrical signal is in the ON state, the flow control valve 26 is closed, so that thereby, as the duty ratio of the pulse electrical signal outputted by the control device 30 increases, the overall flow resistance to hydraulic fluid of said bypass conduit 24 increases, so that thereby the flow rate of the hydraulic fluid supplied as propellant to the hydraulic motor 12 is increased.

An engine coolant temperature sensor 32 is provided as appended to the radiator 52, and outputs an electrical signal indicative of the current value of the temperature of the cooling water or other coolant of the internal combustion engine 50. And a propellant hydraulic fluid temperature sensor 34 is provided as appended to the reservoir tank 20, and outputs an electrical signal indicative of the current value of the temperature of the hydraulic fluid which is contained in said reservoir tank 20 and is being pumped by the hydraulic fluid pump 16 and is being supplied to the hydraulic motor 12 as propellant. Both the engine coolant temperature sensor 32 and the propellant hydraulic fluid temperature sensor 34 supply their output electrical signals to the control device 30.

No concrete illustration of the structure of any particular realization of the control device 30 will be given herein, since various possibilities for the details thereof can be easily supplemented by one of ordinary skill in the electronic and computer programming art based upon the functional disclosures set out in this specification. In the preferred embodiment of the device of the present invention, the control device 30 is concretely realized as a micro computer and its associated circuitry, said micro computer operating at the behest of a control program which will not be detailed herein, since the details thereof which are not disclosed in this specification can likewise be easily supplemented by one of ordinary skill in the electronic and computer programming art based upon the functional disclosures set out herein. However, it should be particularly understood that such realizations in the micro computer form, although preferred, are not the only ways in which the control device 30 can be provided; in other possible embodiments it could be constituted as an electrical device not incorporating a microprocessor. This control device 30 generally functions as will now be explained, so as to control the duty ratio of the pulse electrical signal supplied to the flow control valve 26, so as thereby to control the the overall flow resistance to hydraulic fluid of the bypass conduit 24, thereby controlling the flow rate of the hydraulic fluid supplied as propellant to the hydraulic motor 12, and thus controlling the rotational speed of said hydraulic motor 12.

The Control Provided According to This Preferred Embodiment

Figure 2:
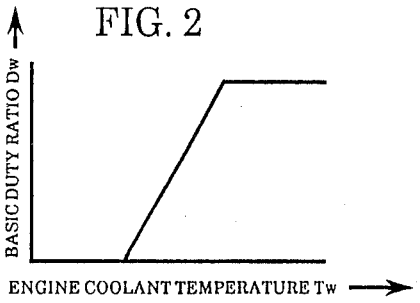
FIG. 2 is a graph for showing the relation between a basic duty ratio value Dw for a pulse electrical signal, shown along the vertical axis, and an engine coolant temperature Tw, shown along the horizontal axis.

First, the control device 30, as shown in FIG. 2, determines a basic value DW for the duty ratio for the pulse electrical signal to be supplied to the flow control valve 26, according to a characteristic curve with respect to the temperature Tw of the coolant of the engine 50 as indicated by the output signal from the engine coolant temperature sensor 32. In this figure, in which this basic duty ratio value Dw is shown along the vertical axis and the engine coolant temperature Tw is shown along the horizontal axis, it is shown that the basic duty ratio value Dw increases along with increase of coolant temperature Tw over a certain range thereof.

Figure 3:
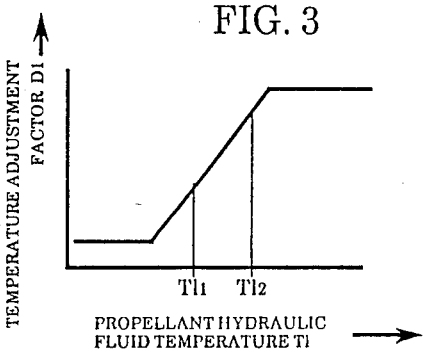
FIG. 3 is a graph for showing the relation between a temperature adjustment value D1 for said pulse electrical signal, shown along the vertical axis, and the temperature T1 of the operating hydraulic fluid for a hydraulic motor for driving said cooling fan, shown along the horizontal axis.

Next, the control device 30, as shown in FIG. 3, determines a temperature adjustment value D1 for the duty ratio for the pulse electrical signal to be supplied to the flow control valve 26, according to a characteristic curve with respect to the temperature T1 of the operating or propellant hydraulic fluid for the hydraulic motor 12 as indicated by the propellant hydraulic fluid temperature sensor 34. In this figure, in which this temperature adjustment value D1 is shown along the vertical axis and the operating hydraulic fluid temperature T1 is shown along the horizontal axis, it is shown that the temperature adjustment value D1: remains at a relatively low constant value along with increase of operating hydraulic fluid temperature T1 up to a first certain determinate value; increases along with further increase of operating hydraulic fluid temperature T1 up to a second certain determinate value; and thereafter remains at a relatively high constant value along the further increase of operating hydraulic fluid temperature T1 above said second certain determinate value.

Then, the control device 30 computes the actual duty ratio D for the pulse electrical signal to be supplied to the flow control valve 26, by multiplying together the basic value DW therefor and the temperature adjustment value D1, and then acts upon this calculation, thus supplying to the flow control valve 26 a controlling pulse electrical signal of this duty ratio D. By this means, the overall flow resistance of said flow control valve 26 is controlled, and thereby the flow rate of the hydraulic fluid supplied as propellant to the hydraulic motor 12 is controlled.

Figure 4:
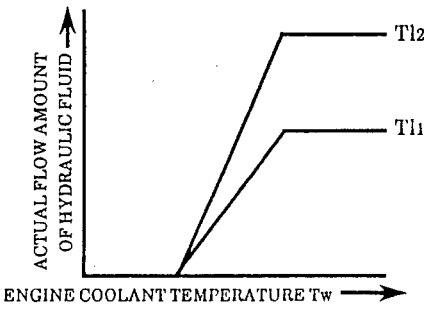
FIG. 4 is a graph for showing the relation provided by said preferred embodiment between an actual flow amount of operating hydraulic fluid provided to and through said hydraulic motor for driving said cooling fan, shown along the vertical axis, and said operating hydraulic fluid temperature T1, shown along the horizontal axis.

Thus, the actual duty ratio D of the controlling pulse electrical signal supplied to the flow control valve 26 is increased both along with a rise in the engine coolant temperature Tw and also along with a rise in the operating hydraulic fluid temperature T1. Therefore, considering the operation of the system for the cases of two different values T11 and T12 of the operating hydraulic fluid temperature T1 as shown in FIG. 3, the characteristics of the actual flow amount of operating hydraulic fluid provided to and through the hydraulic motor 12 with respect to the engine coolant temperature Tw are as shown in FIG. 4, in which said actual operating hydraulic fluid flow amount is shown along the vertical axis and the engine coolant temperature Tw is shown along the horizontal axis. In other words, for any particular value of the engine coolant temperature Tw, the flow amount of propellant hydraulic fluid through the hydraulic motor 12 is increased, the higher is the value of the operating hydraulic fluid temperature T1. Accordingly, the changes in the efficiency of the hydraulic fluid pump 16 and of the hydraulic motor 12 which inevitably occur along with change in the operating hydraulic fluid temperature T1 are compensated for, and accordingly, regardless of the current value of said operating hydraulic fluid temperature T1, the rotational speed of the cooling fan 10 is always properly and stably set to the target rotational speed therefor, and no risk is run that said rotational speed of said cooling fan 10 should be too low or too high for the currently prevailing operational circumstances. Thus, there is run no risk of not providing sufficient cooling effect for said engine 50, and similarly there is run no risk of providing too much cooling effect for said engine 50, or of causing unpleasant fan noise or of lowering engine operational efficiency.

Although the present invention has been shown and described in terms of the preferred embodiment thereof, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiment, or of the drawings, but solely by the scope of the accompanying claims, which follow.

What is claimed is:

1. In a system for controlling the rotational speed of a hydraulically driven cooling fan for an internal combustion engine, the fan being driven by a flow of propellant hydraulic fluid, the system including (a) means for sensing a value representing an operating temperature of the engine; (b) means for sensing an operating temperature of the propellant hydraulic fluid; and (c) means for controlling the flow of propellant hydraulic fluid so as to increase the rate of flow of propellant hydraulic fluid when said means for sensing the value representing the operating temperature of the engine indicates increased operating temperature of the engine, and also for increasing the rate of flow of propellant hydraulic fluid when the means for sensing the operating temperature of the propellant hydraulic fluid indicates increased operating temperature of the propellant hydraulic fluid, wherein said means for controlling the flow of propellant hydraulic fluid comprises means for coordinating a second quantity with the operating temperature of the propellant hydraulic fluid; and means for multiplying said first and second quantities to determine the rate of flow of propellant hydraulic fluid, wherein said means for coordinating the second quantity with the operating temperature of the propellant hydraulic fluid performs the coordination so that the second quantity is a relatively low constant value when the operating temperature of the propellant hydraulic fluid is below a relatively low first temperature, increases uniformly in accordance with increasing temperature of the propellant hydraulic fluid from said first temperature up to a relatively high second temperature, and is a relatively high second constant value when the temperature of the propellant hydraulic fluid is above said second temperature.

* * * * *